US007814714B2

(12) United States Patent
McGary

(10) Patent No.: US 7,814,714 B2
(45) Date of Patent: Oct. 19, 2010

(54) APPARATUS AND SYSTEM TO INCREASE CAPACITY OF GRANULAR MATERIAL STORAGE STRUCTURES

(75) Inventor: Paul McGary, Skidmore, MO (US)

(73) Assignee: Cornbelt Fabric Structures, LLC, Bradford, IL (US)

( * ) Notice: Subject to any disclaimer, the term of this patent is extended or adjusted under 35 U.S.C. 154(b) by 198 days.

(21) Appl. No.: 12/022,466

(22) Filed: Jan. 30, 2008

(65) Prior Publication Data

US 2009/0188184 A1 Jul. 30, 2009

(51) Int. Cl.
*E04H 7/22* (2006.01)

(52) U.S. Cl. ..... 52/192; 52/63; 52/86

(58) Field of Classification Search ..... 52/22, 52/23, 63, 86, 192, 197, 222; 220/666; 4/498, 4/503; 135/96, 124, 156, 158, 119
See application file for complete search history.

(56) References Cited

U.S. PATENT DOCUMENTS

| | | | | | |
|---|---|---|---|---|---|
| 2,278,797 | A | * | 4/1942 | Raymond | 52/89 |
| 2,693,195 | A | * | 11/1954 | Frieder et al. | 135/122 |
| 3,703,241 | A | * | 11/1972 | Kelly et al. | 414/800 |
| 3,727,656 | A | * | 4/1973 | Luders | 383/105 |
| 3,855,643 | A | * | 12/1974 | Sanford et al. | 4/498 |
| 3,857,209 | A | | 12/1974 | Milliken | |
| 3,872,634 | A | | 3/1975 | Seaman | |
| 3,897,622 | A | * | 8/1975 | Utahara | 29/452 |
| 4,128,948 | A | * | 12/1978 | Wood | 34/500 |
| 4,259,819 | A | * | 4/1981 | Wemyss | 52/222 |
| 4,280,306 | A | * | 7/1981 | Milinic | 52/63 |
| 4,364,205 | A | | 12/1982 | Scott | |
| 4,416,928 | A | * | 11/1983 | Carl | 428/38 |
| 4,454,807 | A | | 6/1984 | Wolstenholme | |
| 4,493,248 | A | | 1/1985 | Wolstenholme | |
| 4,502,369 | A | | 3/1985 | Aldag | |
| 4,627,333 | A | | 12/1986 | Anderson et al. | |
| 4,660,337 | A | * | 4/1987 | Ross et al. | 52/192 |
| RE32,536 | E | | 11/1987 | Wolstenholme | |
| 4,726,286 | A | | 2/1988 | Anderson et al. | |
| 4,887,400 | A | | 12/1989 | Carroll | |
| 5,046,695 | A | * | 9/1991 | Vuorenmaa | 248/230.2 |
| 5,343,660 | A | * | 9/1994 | Caoduro et al. | 52/86 |
| 5,381,634 | A | * | 1/1995 | Pietrogrande et al. | 52/86 |
| 5,426,899 | A | * | 6/1995 | Jones | 52/63 |
| 5,752,297 | A | | 5/1998 | Ramey | |
| 6,085,468 | A | | 7/2000 | Quiring et al. | |
| 6,223,476 | B1 | * | 5/2001 | Lemoine | 52/22 |
| 6,474,022 | B1 | * | 11/2002 | Double et al. | 52/3 |
| 6,564,513 | B2 | * | 5/2003 | Henbid et al. | 52/86 |
| 7,118,165 | B2 | | 10/2006 | Nelson et al. | |
| 2002/0083970 | A1 | * | 7/2002 | Langhart | 135/115 |

* cited by examiner

*Primary Examiner*—Brian E Glessner
*Assistant Examiner*—James J Buckle, Jr.
(74) *Attorney, Agent, or Firm*—Larkin Hoffman Daly & Lindgren Ltd.; Thomas J. Oppold

(57) ABSTRACT

An apparatus and method for increasing storage capacity of granular material storage structures. The apparatus includes a curtain assembly supportable from the roof structure of the granular material storage structure and above the sidewalls thereby defining a second volume within which the granular material may be filled which is above the first volume defined by the interior volume of the sidewalls and the volume defined by the angle of repose of the granular material.

17 Claims, 3 Drawing Sheets

APPARATUS AND SYSTEM TO INCREASE CAPACITY OF GRANULAR MATERIAL STORAGE STRUCTURES

BACKGROUND

With the growing popularity of ethanol and bio-diesel driving up prices of corn and soybeans, crop producers are planting more and more acres of these crops. Furthermore, with advances in seed genetics and new hybrids, yields continue to improve. The combination of these two factors has resulted in a shortage of storage facilities during the harvest season at grain elevators and refineries that produce ethanol and soy-diesel. To address the storage facility shortage, temporary or semi-permanent ground storage structures have become increasingly popular due to their relative low cost as compared to conventional grain elevators, silos or bins.

Ground storage structures generally comprise a concrete slab-on-grade surrounded by vertical sidewalls constructed of concrete, steel or timber. These ground storage structures are typically covered with a light-weight roof structure to protect the grain from the environment to minimize spoilage. The roof structures are generally comprised of steel trusses supporting fabric or plastic sheeting. The roof trusses are generally arcuate or curvilinear, but may be any other configuration, including gable or hip configurations, or any other configuration and material suitable for the span and loading conditions in the area as dictated by applicable building codes or sound engineering practices.

In addition to storing grain, ground storage structures are also commonly used for bulk storage of other granular materials for which it is desired to minimize exposure to the environment, such as, for example, road salt used in northern climates during winter months to de-ice roads and improve traction.

It should be appreciated that the majority of the cost of such semi-permanent storage structures is associated with the sidewalls of the structure, whether concrete, steel or timber. Thus, it is desirable to provide a system and method to increase the storage capacity of existing structures to avoid the need for new construction and to reduce the cost per unit of storage volume for such storage structures.

DETAILED DESCRIPTION OF THE INVENTION

Figure 1:
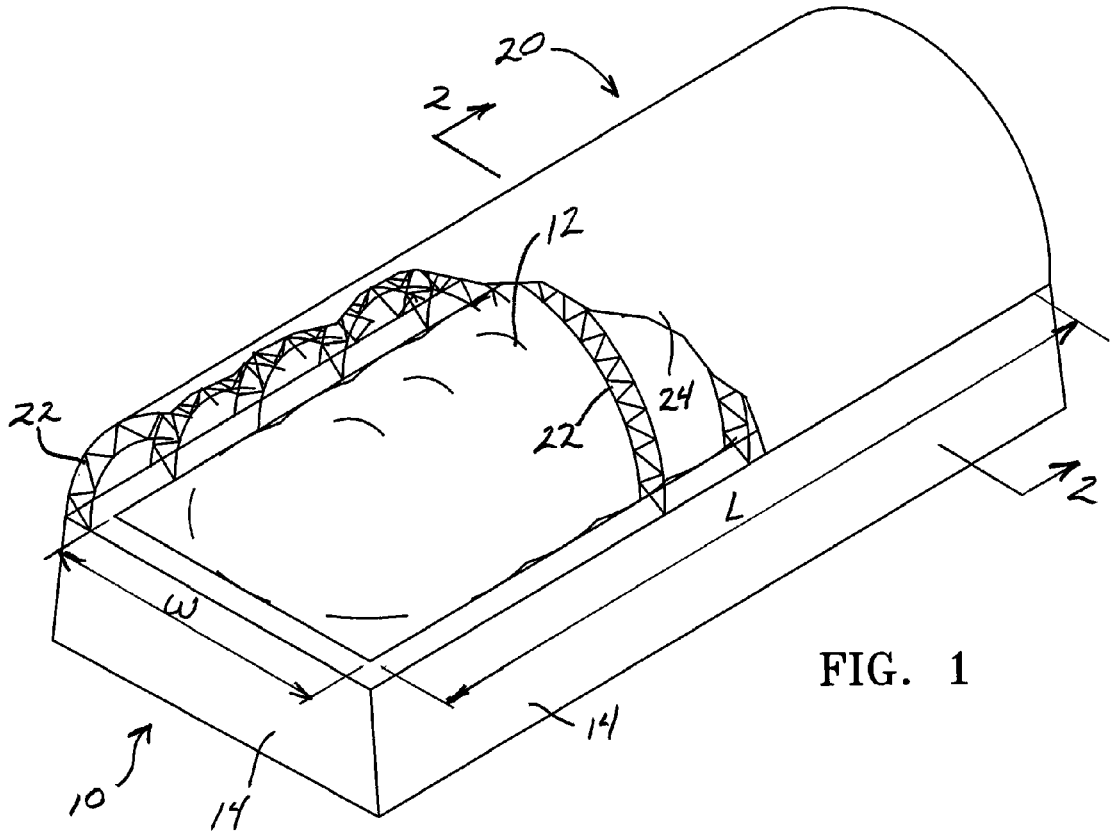
FIG. 1 illustrates a typical or conventional bulk storage structure for granular material.
Figure 2:
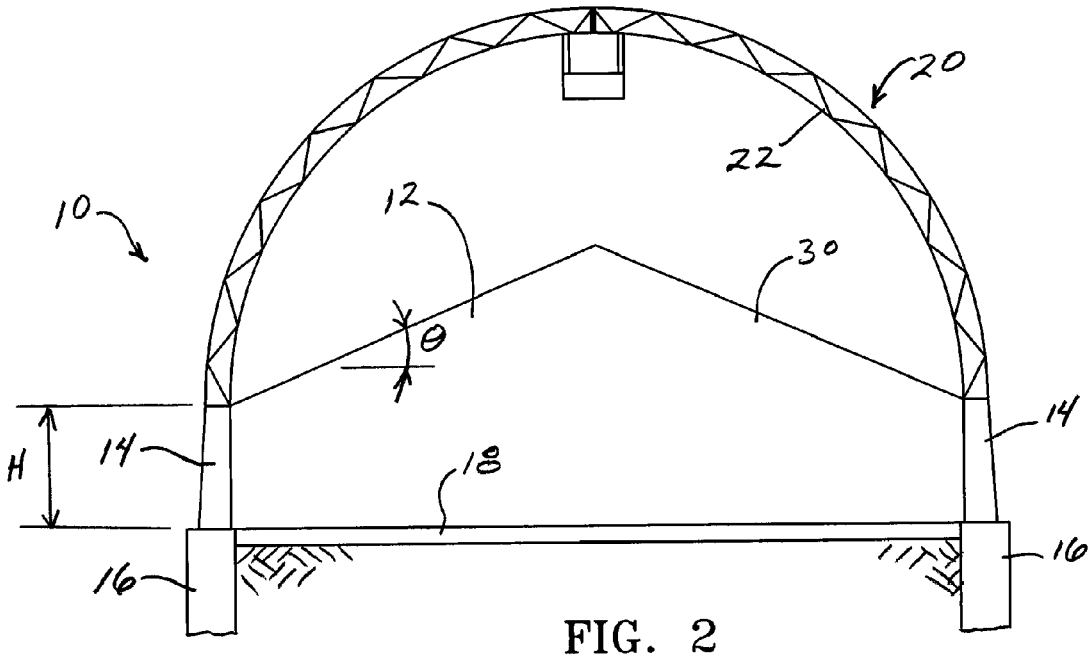
FIG. 2 is a cross-sectional view of the storage structure as viewed along lines 2-2 of FIG. 1.

Referring now to the drawings, wherein like reference numerals designate identical or corresponding parts throughout the several views, FIGS. 1 and 2 illustrate a conventional rectangular ground storage structure 10 within which is stored granular material 12. The storage structure 10 includes peripheral sidewalls 14 have a length "L", a width "W" and a height "H." The sidewalls 14 are supported by an appropriate foundation 16 (FIG. 2). A concrete slab base 18 is supported on-grade. A roof structure 20 is supported by the sidewalls 14.

The roof structure 20 is illustrated as comprising a plurality of spaced arcuate or "hoop" trusses 22 (such as disclosed in U.S. Pat. No. 6,085,468 to Quiring et al., incorporated herein by reference). The trusses 22 support a relatively lightweight fabric sheeting material 24 that is impervious to moisture. It should be recognized however, that granular material storage structures 10 may have any suitable roof structure configuration and may be constructed of any suitable material, including steel, aluminum, timber, etc, limited only by applicable building codes and/or sound engineering practices. The roof trusses 22 are also typically designed to support conveyors or augers used to fill the storage structure with the granular material 12.

The peripheral sidewalls 14 may be constructed of any suitable material, including concrete, steel, timber, compacted earth, etc. The walls 12 are designed to resist the outward forces exerted by the granular material 12.

Granular material such as grain, sand, road salt, etc., will naturally form a conical pile when poured onto a horizontal surface. The slope of the conical pile that forms is referred to as the "angle of repose" which depends on the density, surface area, and coefficient of friction of the material. For shelled dry corn, for example, the angle of repose is approximately twenty-three degrees. For soybeans and wheat, the average angle of repose is approximately twenty-five degrees. For dry sand and road salt, the average angle of repose is approximately thirty-three degrees. Accordingly, it should be understood that the volume of material 12 that can be stored within any storage structure 10 is the volume defined by the peripheral sidewalls 14 (the "wall volume" 26) plus the volume of the material that may be piled above the walls 14 (the "repose volume" 28). The storage volume defined by the wall volume 26 plus the repose volume 28 is hereinafter referred to as the "first storage capacity" 30. It should be appreciated that the repose volume 28 is presumed to be limited only by the angle of repose and the distance between the sidewalls 14. However, it should be appreciated that in some instances, the roof structure 20 may have a height and slope less than the angle of repose, such that the maximum height of the volume of the granular material pile above the walls 14 is restricted by the roof structure.

As an example, for a square storage structure 10 having peripheral sidewalls 14 with a length "L", a width "W" and a wall height "H" and with the granular material 12 having an angle of repose "θ", the first storage capacity 30 may be calculated by determining the wall volume 26 (i.e., L×W×H) and adding the repose volume 28 as defined by the volume of the cone formed by the material 12 piled above the walls 14 (i.e., $\frac{1}{3}((\pi\times W\times W\div 4)\times\frac{1}{2}W(\tan\theta))$), where the width "W" defines the diameter of the cone.

For a rectangular storage structure 10, the calculation of the first storage capacity 30 is the wall volume 26 (i.e., L×W×H) plus the repose volume 28 defined by the triangular prism with conical ends formed by the material that can be piled above the walls 14. Thus, the first storage capacity 30 for a rectangular storage structure 10 may be calculated using the following formula:

$$V=(L\times W\times H)+(\tfrac{1}{3}((\pi\times W\times W\div 4)\times\tfrac{1}{2}W(\tan\theta))+(\tfrac{1}{2}W(\tan\theta)\times(L-W))$$

Similarly, for a cylindrical structure 10, having a diameter "D" and a wall height "H" and with the granular material having an angle of repose "θ", the first storage capacity 20 is equivalent to the wall volume 26, defined by the walls 14 of the cylindrical structure ($(\pi \times D \times D \div 4) \times H$), plus the repose volume 28, defined by the cone formed by the material 12 piled above the walls 14 (i.e., $\frac{1}{3}((\pi \times D \times D \div 4) \times \frac{1}{2}D(\tan \theta))$).

It should be appreciated that if it is desired to increase the overall volume of an existing storage structure 10 without increasing the height, length or width of the sidewalls 14, the only option is to overfill the structure 10, such that the material 12 fills in any open volume between the roof structure 20 and the first storage capacity. However, as previously described, the roof structures 20 that are typically used for conventional storage structures 10 are lightweight and generally constructed of a plastic or fabric sheeting 24 secured intermittently to the roof trusses 22. Thus, if the granular material 12 were permitted to pile against the plastic or fabric roof sheeting 24, the sheeting 24 would eventually tear or pull away from the roof trusses 22 due to the ever increasing horizontal force that would be exerted against the sheeting as the material 12 continues to pile up. Any tear or pulling away of the sheeting 24 from the truss 22 would permit the granular material to spill out over the top of the walls 14 until the natural angle of repose is again achieved.

Accordingly, the present invention permits the overfilling of the structure 10 while protecting the roof structure 20, particularly the sheeting 24 of the roof structure, from being exposure to the outward or horizontal forces exerted by the material 12 as the material piles up above the sidewalls 14.

Figure 3:
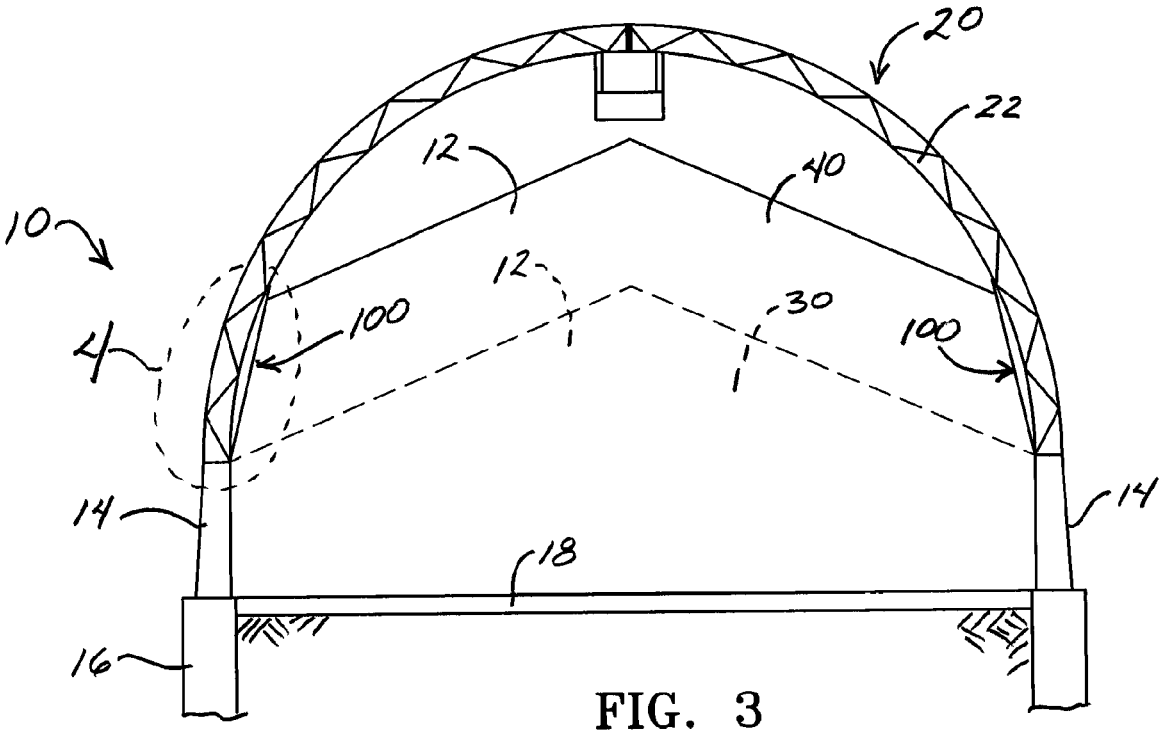
FIG. 3 is a cross-sectional view of a storage structure similar to FIG. 2 but with an embodiment of the curtain assembly of the present invention installed thereby providing the second storage capacity above the first storage capacity as illustrated.
Figure 4:
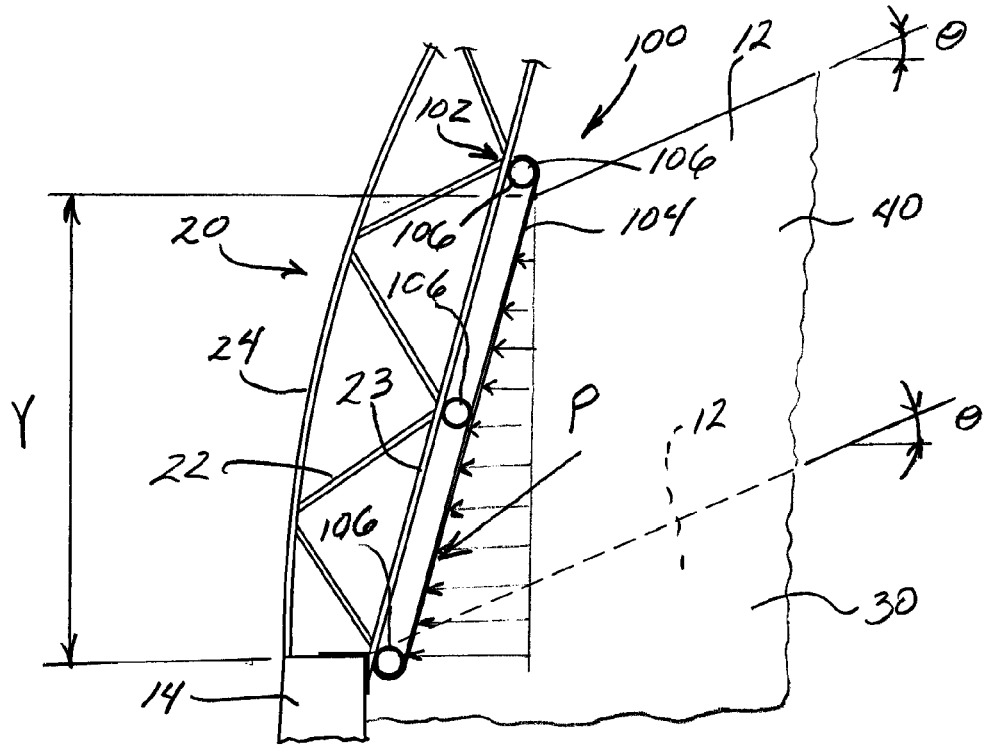
FIG. 4 is an enlarged view of the portion of the curtain assembly identified by reference numeral 4 in FIG. 3.

Referring to FIGS. 3 and 4, the present invention comprises a curtain assembly 100 that is supported by the roof truss 22 preferably along the entire length "L" of the storage structure 10 on opposing sidewalls 14. In the preferred embodiment, the curtain assembly 100 is secured at a bottom end to the roof truss 22 preferably just below the top of the wall 14. The top of the curtain assembly 100 is secured to the roof truss 22 a predetermined distance "Y" above the top wall 14. The predetermined distance "Y" that the curtain assembly 100 extends above the top of the wall 14 will depend primarily on the additional storage capacity desired, the height of the roof structure 20 within which additional granular material can be piled before the apex of the conical pile reaches the top of the roof structure 20, and the ability of the truss 22 and/or walls 14 to withstand the additional load that will be exerted by the overfilling. The additional storage capacity provided by the curtain assembly 100 is hereinafter referred to as the "second storage capacity" 40 and is defined as the volume of additional granular material 12 above the first storage capacity 30.

As illustrated in FIG. 4, the second storage capacity 40 exerts a resultant load "P" on the curtain assembly 100 and thus on the truss 22. The magnitude of the resultant load "P" increases as the distance "Y" increases. The truss 22, the walls 14 and the footings 16 must be capable of resisting the resultant load P.

Figure 5:
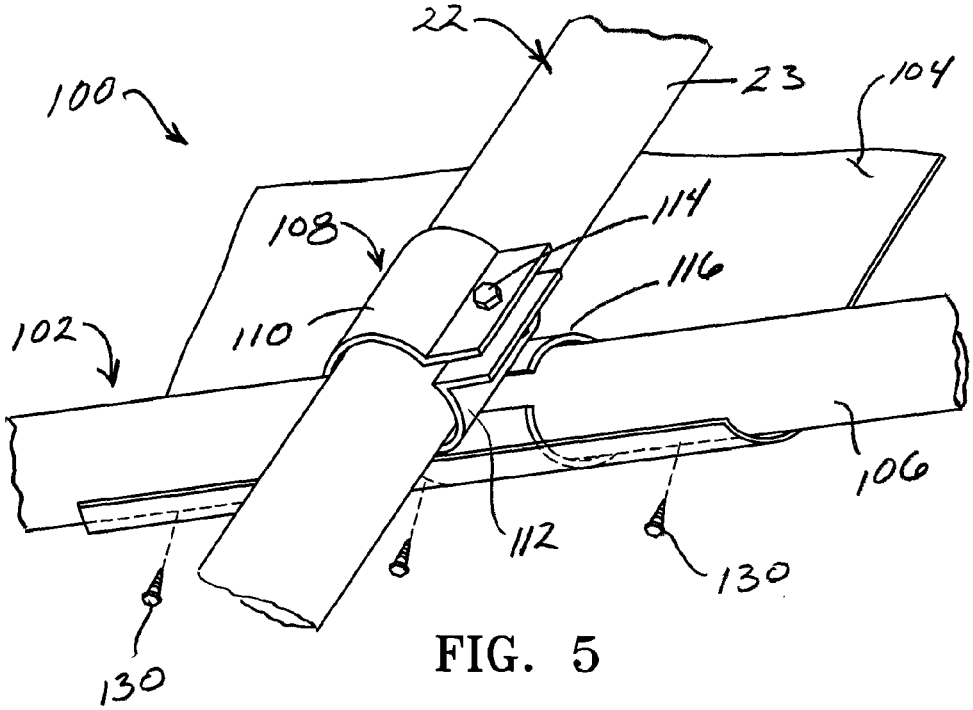
FIG. 5 is a perspective view showing a one embodiment for supporting the curtain assembly of FIG. 3 to a roof truss member of the storage structure.
Figure 6:
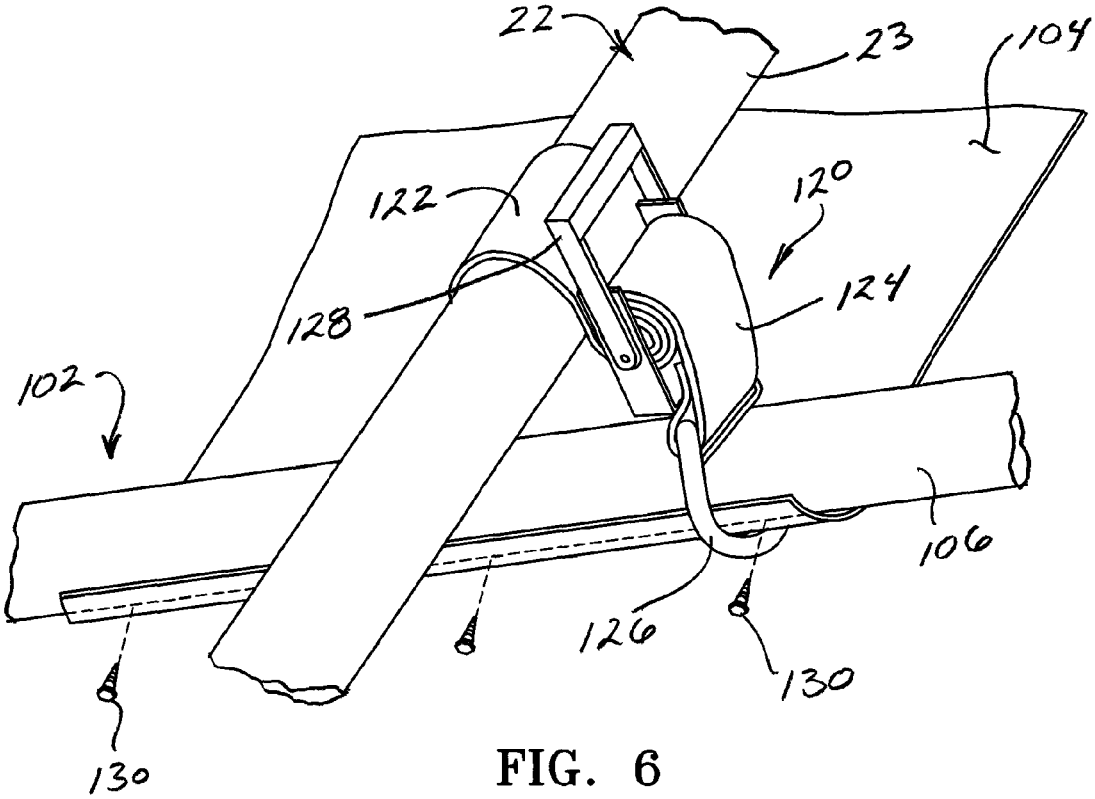
FIG. 6 is a perspective view showing another embodiment for supporting the curtain assembly of FIG. 3 to a roof truss member of the storage structure.

Referring to FIGS. 4-6, in the preferred embodiment, the curtain assembly 100 preferably includes a curtain frame 102 which supports a curtain 104. The curtain frame 102 preferably comprises a plurality of beams 106 extending transversely to the roof trusses 22. The number of beams 106 required will depend on the height "Y" of the curtain assembly 100 and the spacing of the roof trusses 22. The beams 106 may be supported from the bottom cord 23 of the roof trusses 22 by any convenient means. For example, in FIG. 5 a saddle bracket 108 is used to secure the beams 106 to the bottom cord 23. The saddle bracket is illustrated as comprising top and bottom saddle members 110, 112 secured by a bolted connection 114. The bottom saddle member 112 is welded to a sleeve 116 that receives the beam 106.

FIG. 6 illustrates the use of a conventional ratchet strap 120 to support the beam 106 from the bottom cord 23. In this embodiment, a hook 122 on one end of the strap 124 is hooked over the bottom cord 23 and the other hook 126 at the other end of the strap 124 is hooked under the beam 106. By moving the handle 128 of the ratched strap 120 back and forth, a winch mechanism (not visible) causes the strap 124 to roll upon itself thereby drawing the beam 106 toward the bottom cord 23, and securely but removably holding the two components in fixed relation until released. It should be appreciated that any apparatus suitable for supporting the beam from the bottom cord of the roof truss may be used in connection with the present invention.

The curtain 104 is preferably removably fastened to the frame 102 preferably by tapping screws 130 that extend through the curtain 104 and into beams 106 at closely spaced intervals. Grommets (not shown) may be provided in the curtain 104 to prevent tearing. As an alternative embodiment, rather than fastening the curtain 104 to the frame 102 with tapping screws 130, the curtain 104 may itself include sleeves (not shown) which receive the beams 106. Various other bracket embodiments and means for attaching the curtain 104 to the curtain frame 102, and for supporting the frame 102 from the trusses 22 may be equally suitable as recognized by those of skill in the art, including, for example resilient C-shaped clamps such as disclosed in U.S. Pat. No. 5,752,297 to Ramey, which is incorporated herein by reference.

The curtain 104 is preferably comprised of a lightweight, durable nylon mesh or netting material that does not easily tear. A mesh or netting material is preferable to permit air to pass through the material thereby minimizing sweating of the granular material, which is of particular concern for grain storage as sweating or moisture can cause the grain to spoil. As an alternative to nylon mesh, other material for the curtain may be equally suitable, including, for example, woven fabric, plastic, plywood, etc.

The foregoing description is presented to enable one of ordinary skill in the art to make and use the invention and is provided in the context of a patent application and its requirements. Various modifications to the preferred embodiment of the apparatus and the general principles and features described herein will be readily apparent to those of skill in the art. Thus, the present invention is not to be limited to the embodiments of the apparatus and methods described above and illustrated in the drawing figures, but is to be accorded the widest scope consistent with the spirit and scope of the appended claims

The invention claimed is:

1. In combination, a first and second quantity of granular material and a granular material storage system, the granular material storage system comprising:

a) a first granular material storage capacity for receiving the first quantity of granular material, said first granular material storage capacity comprising a wall volume and a repose volume of the first quantity of granular material, said wall volume defined by a wall structure;

b) a roof structure comprising a plurality of spaced roof trusses supported by said wall structure, each of said roof trusses having a bottom cord; and c) a curtain having top and bottom ends operably secured to said bottom cord of said roof trusses above said wall structure such that said curtain is substantially parallel with said bottom cord of said roof trusses, said curtain defining a second granular material storage capacity for receiving the second quantity of granular material above said first granular material storage capacity.

2. The combination of claim 1 wherein said wall structure includes a first sidewall and a second sidewall disposed on opposite sides of said wall volume, and wherein said plurality of roof trusses are supported on opposite sides by said first sidewall and said second sidewall.

3. The combination of claim 2 wherein said curtain comprises a curtain frame, said curtain frame having an upper beam and a lower beam with said curtain spanning a distance there between, wherein said upper beam and said lower beam are operably secured to said bottom cords of said spaced roof trusses.

4. The combination of claim 3 wherein said curtain is fabric.

5. The combination of claim 4 wherein said fabric is a mesh material.

6. The combination of claim 3 wherein said curtain frame is operably removably secured to said bottom cord of said roof trusses.

7. The combination of claim 6 wherein said curtain is removably secured to said upper and lower beams.

8. The combination of claim 6 further comprising a plurality of brackets removably securing said upper and lower beams to said bottom cords of said spaced roof trusses.

9. The combination of claim 8 wherein each of said plurality of brackets comprises a top saddle member and bottom saddle member between which is received a bottom cord of one of said roof trusses, said lower beam received within a sleeve fixed to said bottom saddle member.

10. The combination of claim 6 further comprising a plurality of ratchet straps removably securing said upper and lower beams to said spaced roof trusses.

11. A granular material storage system, comprising:

a) a wall structure having a first storage capacity comprising a wall volume and a repose volume;

b) a roof structure supported by said wall structure;

c) a curtain assembly supported from said roof structure above said wall structure, said curtain assembly providing an interior volume above said first storage capacity defining a second storage capacity, said curtain assembly comprising a curtain supported by a curtain frame, wherein said curtain frame includes substantially parallel upper and lower beams disposed substantially transverse to said spaced roof trusses supported thereby and wherein said upper beam is spaced a predetermined distance vertically above said lower beam; and d) a plurality of brackets removably securing said upper and lower beams to said spaced roof trusses, wherein each of said plurality of brackets comprises a top saddle member and a bottom saddle member between which is received a bottom cord of one of said roof trusses, said lower beam received within a sleeve fixed to said bottom saddle member.

12. The granular material storage system of claim 11 further comprising a plurality of ratchet straps removably securing said upper and lower beams to said spaced roof trusses.

13. In a system to increase capacity of a granular material storage facility within which granular material is stored, the facility having a wall structure and a roof structure supported by the wall structure, the wall structure defining a first storage capacity comprising a wall volume and a repose volume of the granular material, the system comprising:

a curtain having an upper and lower edge, the curtain secured to a lower cord of the roof structure at a position adjacent and above the wall structure such that the curtain is substantially parallel with the lower cord of the roof structure, wherein the curtain member provides a surface above the wall structure against which the granular material comes in contact during use thereby defining an additional interior volume which creates additional storage capacity above the first storage capacity.

14. The system of claim 13 wherein said curtain is nylon mesh.

15. The system of claim 13 wherein said curtain is woven fabric.

16. The system of claim 13 wherein said curtain is plastic.

17. The system of claim 13 wherein said curtain is plywood.

* * * * *